US005860799A

United States Patent [19]

Scheibe et al.

[11] Patent Number: 5,860,799

[45] Date of Patent: Jan. 19, 1999

[54] PULSATION DAMPER FOR MARINE TANK PUMPOUT SYSTEMS

[75] Inventors: Mark E. Scheibe, Wooster, Ohio; James A. Sigler, Perrysville, Ohio; William J. Friedman, Wooster, Ohio

[73] Assignee: Sealand Technology, Inc., Big Prairie, Ohio

[21] Appl. No.: 806,717

[22] Filed: Feb. 27, 1997

[51] Int. Cl.[6] ..... F04B 11/00

[52] U.S. Cl. ..... 417/540; 417/543; 137/207; 137/568

[58] Field of Search ..... 417/540, 543; 137/207, 568, 800

[56] References Cited

U.S. PATENT DOCUMENTS

| | | | |
|---|---|---|---|
| 1,774,095 | 8/1930 | Hajek . | |
| 1,777,891 | 10/1930 | Pearson . | |
| 1,958,009 | 5/1934 | McKee . | |
| 2,118,234 | 5/1938 | Rupp | 417/543 |
| 2,148,957 | 2/1939 | Morris et al. | 417/543 |
| 2,561,528 | 7/1951 | Meyers . | |
| 3,853,147 | 12/1974 | Cibulka . | |
| 4,032,265 | 6/1977 | Miller . | |
| 4,177,023 | 12/1979 | Kamiya, et al. . | |
| 4,214,611 | 7/1980 | Takacs, et al. . | |
| 4,585,400 | 4/1986 | Miller . | |
| 4,854,827 | 8/1989 | McKiernan, et al. . | |
| 5,064,360 | 11/1991 | Blum . | |
| 5,129,427 | 7/1992 | White et al . | |
| 5,141,415 | 8/1992 | Budecker et al. . | |
| 5,199,856 | 4/1993 | Epstein et al. . | |
| 5,433,163 | 7/1995 | McKiernan . | |

*Primary Examiner*—Charles G. Freay
*Attorney, Agent, or Firm*—Nixon & Vanderhye P.C.

[57] ABSTRACT

A marine tank (such as a toilet system holding tank, or bilge tank) pump out system includes a positive displacement pump connectable at the inlet to a marine tank to be pumped out and connectable at the outlet to a discharge tank or area. A pulsation dampener is connected between the pump outlet and the discharge tank or area, preferably directly to the pump so that a pump check valve is within the pulsation dampener. The pulsation dampener has an open chamber extending upwardly from the pump outlet into which pumped fluent material may flow, and has no moving parts (such as a diaphragm). Typically two different outlets from the dampener are provided for versatility and connecting up to discharge tanks or areas, one of the outlets filled with a plug. The dampener may comprise either a substantially L-shaped or C-shaped (when viewed from the dampener inlet) casing, which nests with the pump motor.

22 Claims, 7 Drawing Sheets

PULSATION DAMPER FOR MARINE TANK PUMPOUT SYSTEMS

BACKGROUND AND SUMMARY OF THE INVENTION

Pumpout stations are used at many docks, and also for recreational vehicles, such as to facilitate pumping out of sewage holding tanks. A typical pump system for such a pumpout station is shown in U.S. Pat. No. 4,854,827 (the disclosure of which is hereby incorporated by reference herein), and various equipment utilizable with such stations is shown in U.S. Pat. No. 5,433,163 (the disclosure of which is also incorporated by reference herein).

Pumpout stations typically use positive displacement pumps, such as reciprocating action diaphragm pumps, to effect pumpout. While such pumps are effective in performing their desired task, they cause the velocity of the fluent material being pumped to constantly change during operation. During the intake stroke of the pump the fluent material which previously left the pump during the discharge stroke slows down. When the pump begins the discharge stroke again, all of the fluent material from the previous stroke now must be pushed further down the line. The fluid on both sides of such pumps (suction and discharge) actually comes to essentially a complete stop each time the pump completes one cycle. This start/stop action creates pressure spikes which are transmitted by the fluent material itself. These pressure spikes not only cause wear on the valves, diaphragm, and drive train, they also dictate the maximum discharge distance and elevation that the pump is capable of reliably achieving. Tests have demonstrated that if the discharge peak pressure is increased the diaphragm and drive train lives life are reduced, and if the discharge peak pressure is high enough the valves will fail.

According to the present invention the problems associated with the prior art pumpout stations, as described above, can be substantially solved by the use of a pulsation dampener. The pulsation dampener greatly decreases the pressure spikes created by a given discharge configuration. Reducing the pressure spikes inherently increases pump reliability, and also allows the pump to pump further and higher while maintaining the same range of pressure peaks. In some installations the addition of a pulsation dampener can eliminate the need for a lift station. In one test of a marine tank pumpout system according to the invention, which had a peak pressure of about 56 psi, an approximately 150 foot horizontal run of 1.5 inch diameter rigid PVC pipe, and a discharge elevation of about eight feet, when a suitable pulsation dampener (according to the invention) is installed the pressure peaks were reduced to about 16 psi.

Pulsation dampeners are well known per se for pumping systems which have problems with pressure spikes. However in modern times pulsation dampeners are almost universally provided with some sort of moving part, which separates the readily compressible gas in the pulsation dampener from the fluent material being pumped. Each time the pump discharges into the chamber of the pulsation dampener the resistance to flow caused by restrictive fittings, long horizontal runs, or elevated discharges causes the fluid level in the pulsation dampener chamber to increase, pressuring the air trapped in the top portion of the chamber. Since it is easier for the pump to compress the air in the chamber than it is to rapidly move the fluent material through the lines, the discharge stroke is essentially distributed over a longer period of time. That is each time the pump completes the discharge stroke and begins an intake stroke the compressed air in the chamber dissipates pushing the fluent material through the outlet of the pulsation dampener, resulting in pressure peaks being reduced for a given installation. Typical prior art systems which utilize a bladder, or some other method of providing moving parts so that air being compressed and the fluent material being pumped are separated in the pulsation dampener, are shown in U.S. Pat. Nos. 5,129,427, 5,199,856, and 1,958,009.

While bladders, or like moving components, can be effective in pulsation dampeners, they are expensive and can wear out, especially if subjected to the type of environment they normally are in a pumpout station. Therefore it is undesirable to use them. However it has been widely felt in the art that if a bladder or like separation mechanism is not used in a pulsation dampener, over time the air charged in the chamber will dissipate into the fluent material being pumped and the pulsation dampener will become flooded. It is for this reason that as a practical matter pulsation dampeners without moving parts are typically not used.

According to the present invention it has been recognized that for marine tank pumpout systems, and similar embodiments, that the problem of flooding of the pulsation dampener chamber does not occur quickly enough to be of any practical significance given the fact that such pumpout systems are normally operated so that different tanks (such as marine holding tanks in ships or boats) are continually being connected to and disconnected from a hose inlet to the pumpout system. It has been found that because of this relatively frequent connection and disconnection each time the pump is turned on the pump pulls air into the system which is caused to pass into the pulsation dampener chamber thereby "recharging" the pulsation dampener. Also near the end of the pumpout of a tank, air will also be pulled into the system, again "recharging" the pulsation dampener. This air-introducing function both at the beginning and the end of each use of the pumpout system means that as a practical matter in marine tank pumpout systems bladderless pulsation dampeners may be utilized without any adverse consequences, resulting in a pulsation dampener that is cheaper and more reliable with more longevity. Pulsation dampeners according to the invention can thus also be configured into very special shapes (which would not be possible or practical if bladders or like moving parts were included) so that a minimum of volume is taken up by the pulsation dampener. As a matter of fact according to the preferred embodiments of the invention a pulsation dampener may be incorporated into a marine tank pump out system without increasing in any way the useful space taken up by the pumpout system, so that existing pumpout systems may be readily retrofit with pulsation dampeners.

According to one aspect of the present invention a marine tank pumpout system is provided comprising the following components: A positive displacement pump having an inlet and an outlet. The inlet and outlet each including at least one check valve. A first connection to the inlet to connect the inlet to a marine tank to be emptied. A pulsation dampener having an inlet connected to the pump outlet and including an open chamber extending upwardly from the pump outlet into which pumped fluent material may flow; the pulsation dampener also including at least one outlet from the chamber; the chamber including no moving parts. And, a second connection from the pulsation dampener to connect the pulsation dampener to a discharge tank or area.

Preferably the pulsation dampener has first and second differently directed outlets, and one of the pulsation dampener outlets is connected to the connection to a discharge area or tank, while the other includes a plug disposed therein. Also typically a check valve from the pump outlet extends into the pulsation dampener inlet to minimize the useful area taken up by the pulsation dampener. The pump typically includes a reciprocating diaphragm pump and the lo pulsation dampener inlet is directly connected to the pump outlet, and typically the pulsation dampener has an interior volume of between about 250–400 cubic inches.

The pulsation dampener may be substantially L-shaped when viewed from the dampener inlet and includes a first portion generally having a substantially parallelepiped configuration and containing the inlet and the outlets, and a second portion generally having a substantially parallelepiped configuration and extending vertically upwardly from the first portion and defining the majority of the chamber. The pump typically includes a motor and the motor and pulsation dampener are positioned with respect to each other so that the motor nests with the pulsation dampener with the motor above the first portion and next to the second portion, so that the system takes up substantially no more useful space with the pulsation dampener than without it. This is important for many docks where the volume for the pumpout system is limited, and to facilitate retrofit of existing installations. In this embodiment the at least one outlet in the first portion typically comprises a first outlet horizontally aligned with the inlet, and a second outlet opening downwardly.

Alternatively the pulsation dampener may be generally C-shaped when viewed from the dampener inlet and includes a first portion having a substantially parallelepiped configuration and containing the inlet and the outlets; a second portion extending vertically upwardly from the first portion and having a bottom area significantly less than a top area of the first portion; and a third portion extending horizontally outwardly from the second portion at a top of the second portion and overhanging the first portion. The second portion may include a side wall overlying the dampener inlet and extending at an angle of between about 30°–60° (e.g. about 45°) to the horizontal back toward the pump. In this case the motor and the pulsation dampener are positioned with respect to each other so that the motor nests with the pulsation dampener with the motor between the first and third portions, and adjacent a second portion, so that—again—the system takes up substantially no more useful space with the pulsation dampener than without it. In this embodiment the first portion at least one outlet typically comprises a first outlet facing downwardly from the first portion, and a second outlet disposed substantially perpendicularly to the inlet, and horizontally directed.

Typically a flexible hose with a releasable connection (as described in U.S. Pat. No. 5,433,163) is provided for connection to a marine tank, and the system is in combination with a marine tank so that the pump withdraws fluent material from the marine tank and pumps it to a discharge tank or area. The marine tank may comprise a holding tank for marine toilet systems, a bilge tank, a liquid product tank on a boat or ship, etc.

According to another aspect of the present invention a pulsation dampener per se is provided comprising: A pulsation dampener casing comprising: an inlet connectable to a pump outlet; an open chamber extending upwardly from the inlet into which pumped fluent material may flow; at least one outlet from the chamber; and the chamber including no moving parts; and wherein the pulsation dampener casing is substantially L-shaped when viewed from the dampener inlet and includes a first portion generally having a substantially parallelepiped configuration and containing the inlet and the outlets, and a second portion generally having a substantially parallelepiped configuration and extending vertically upwardly from the first portion and defining the majority of the chamber.

Typically the at least one outlet in the first portion comprises a first outlet horizontally in line with the inlet, and a second outlet opening downwardly, a plug disposed in one of the outlets. The casing typically comprises 11 gauge stainless steel (e.g. 316L stainless), although less expensive materials such as fiberglass, or even plastic without reinforcing materials, may under some circumstances be suitable. The interior volume of the pulsation dampener is typically between about 250–400 cubic inches.

According to another aspect of the present invention a pulsation dampener is provided comprising: A pulsation dampener casing comprising: an inlet connectable to a pump outlet; an open chamber extending upwardly from the inlet into which pumped fluent material may flow; at least one outlet from the chamber; and the chamber including no moving parts; and wherein the pulsation dampener casing is generally C-shaped when viewed from the dampener inlet and includes a first portion having a substantially parallelepiped configuration and containing the inlet and the outlets; a second portion extending vertically upwardly from the first portion and having a bottom area significantly less than a top area of the first portion; and a third portion extending horizontally outwardly from the second portion at a top of the second portion and overhanging the first portion.

The second portion of the pulsation dampener typically includes a side wall overlying the dampener inlet, and extending at an angle of between about 30°–60° (e.g. about 45°) to the horizontal back over and horizontally past the inlet. The first portion at least one outlet typically comprises a first outlet facing downwardly from the first portion and a second outlet disposed substantially perpendicularly to the inlet, and horizontally directed, with a plug disposed in one of the outlets. The interior volume of the pulsation dampener of this embodiment is substantially the same as for the previous embodiment.

It is the primary object of the present invention to provide a marine tank pumpout system with an effective pulsation dampener, and a pulsation dampener per se, especially one that is easily retrofit to existing pumpout systems and has no moving parts, and takes up substantially no more useful space than if the pulsation dampener is not utilized. This and other objects of the invention will become clear from an inspection of the detailed description of the invention and from the appended claims.

DETAILED DESCRIPTION OF THE DRAWINGS

Figure 1:
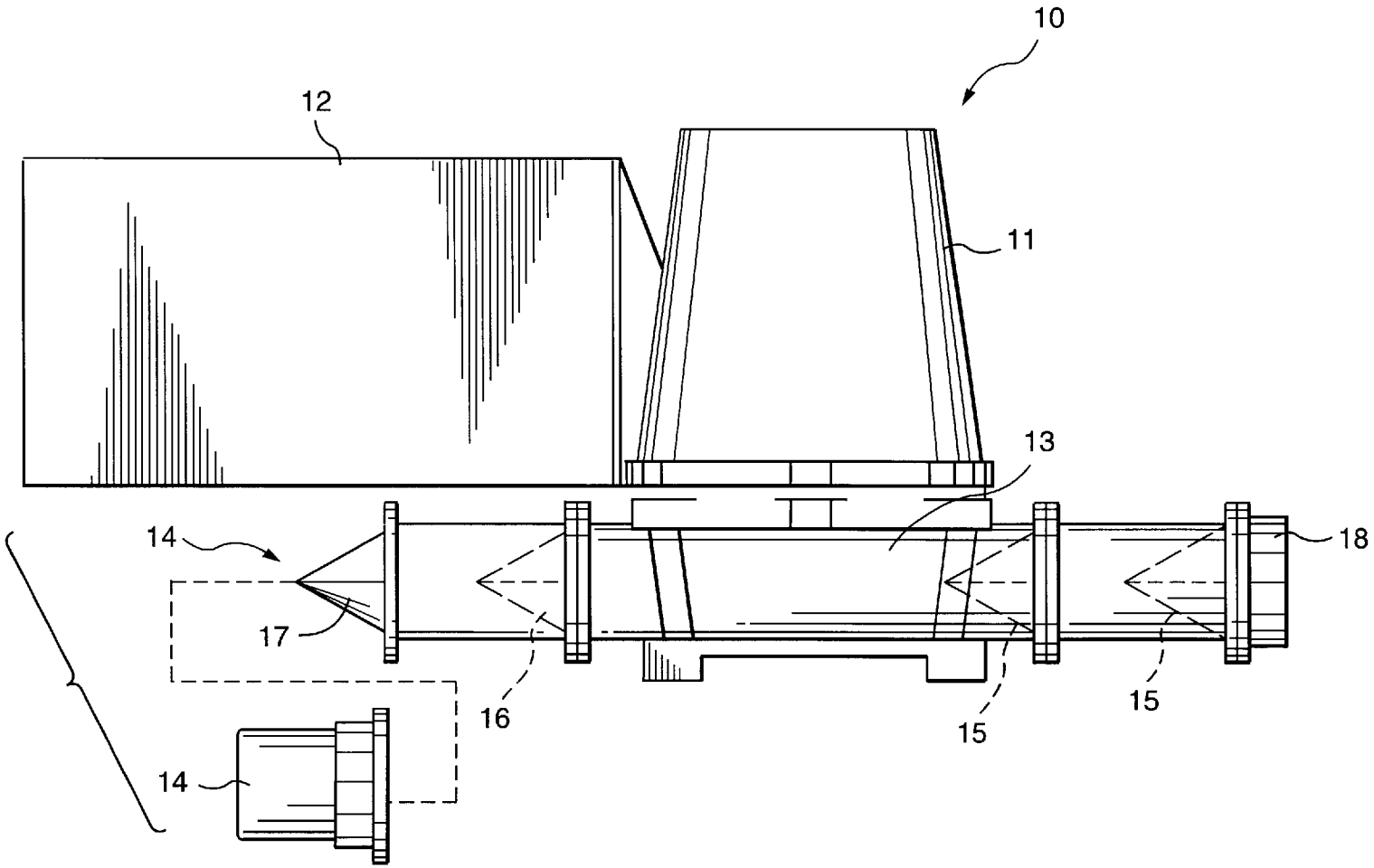
Fig. 1 (PRIOR ART)
FIG. 1 is a side view, with the check valve illustrated for clarity of illustration, of a conventional marine tank pumpout system pump assembly, which may utilized with the pulsation dampener according to the invention.

FIG. 1 schematically illustrates a conventional pump station pump assembly, such as shown in U.S. Pat. No. 4,854,827 and utilized with the system of U.S. Pat. No. 5,433,167. The pump assembly shown generally by reference numeral 10 includes a positive displacement pump 11 (preferably a reciprocating diaphragm pump) powered by a motor 12 which is connected directly to the pump 11, typically through a gear train (not shown). The pump includes an inlet 13 and an outlet 14 (shown with a disconnected end termination 14' in FIG. 1), and at least one check valve in each of the inlet 13 and outlet 14. Preferably the check valves are duckbill valves, such as the check valves 15 illustrated in association with the inlet 13, and similar valves 16 and 17 shown associated with the outlet 14. A connection 18 is provided to connect the inlet 13 to a marine tank to be emptied (as described in U.S. Pat. Nos. 5,433,163 and 4,854,827), and a second connection (not shown) is provided to connect the end termination 14' of the outlet 14 to a discharge tank or area.

An exemplary pulsation dampener according to the present invention is shown generally by reference numeral 20 in FIGS. 2 through 5, and is readily retrofit to the conventional existing pumpout assembly 10 of FIG. 1. The pulsation dampener 20 includes an inlet 21 formed in an inlet plate 22 and at least one outlet (preferably a first outlet 23 and a second outlet 24), the outlets seen, at least schematically, in FIGS. 3 through 5. The pulsation dampener 20 includes an open chamber 26 (see FIG. 2 in particular) extending upwardly from the pump outlet 14 (and from the dampener inlet 21) into which pumped fluent material may flow. The chamber 26 has no moving parts (such as a diaphragm, movable wall, spring biased piston, or the like).

Figure 2:
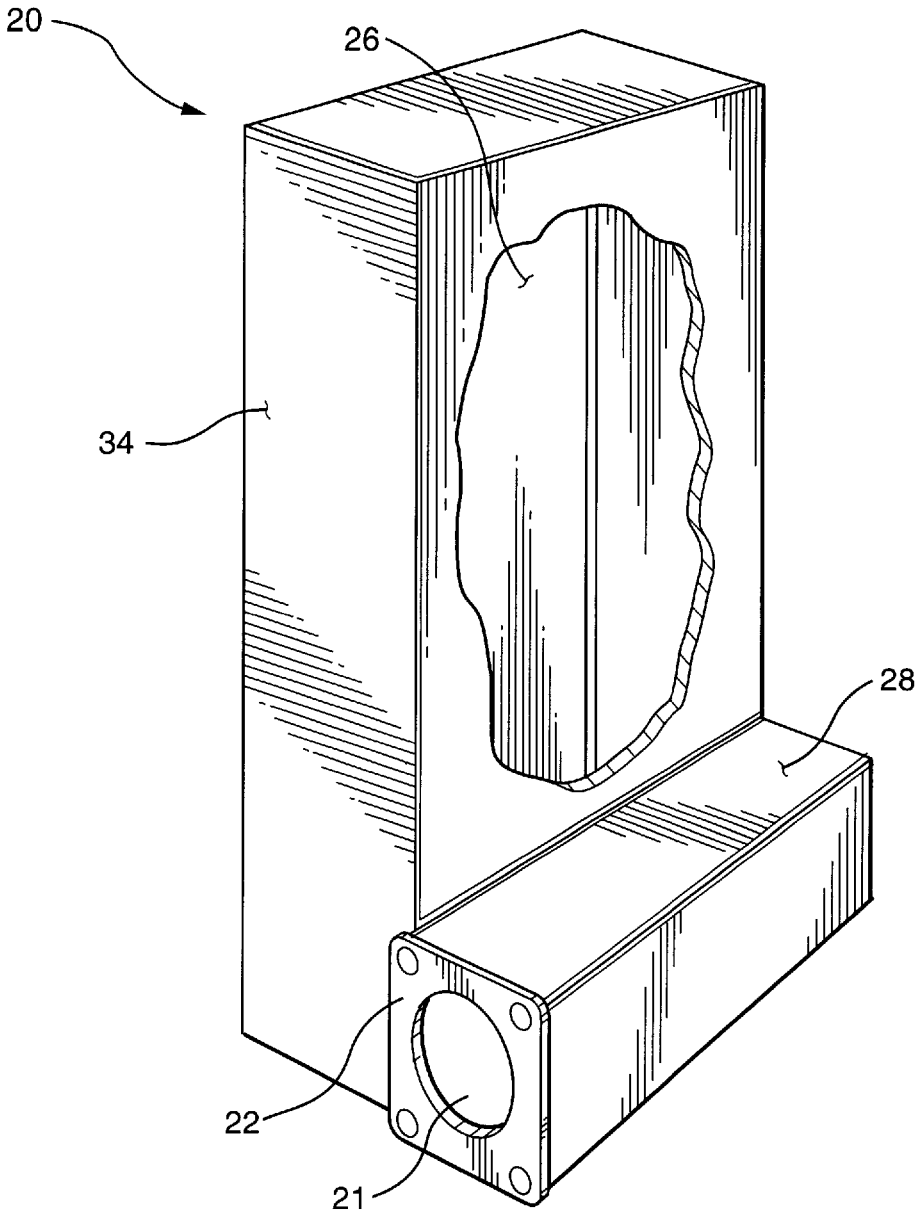
FIG. 2 is a perspective view of an exemplary pulsation dampener utilizable with the pump system of FIG. 1, with one of the exterior walls cut away for clarity of illustration.
Figure 3:
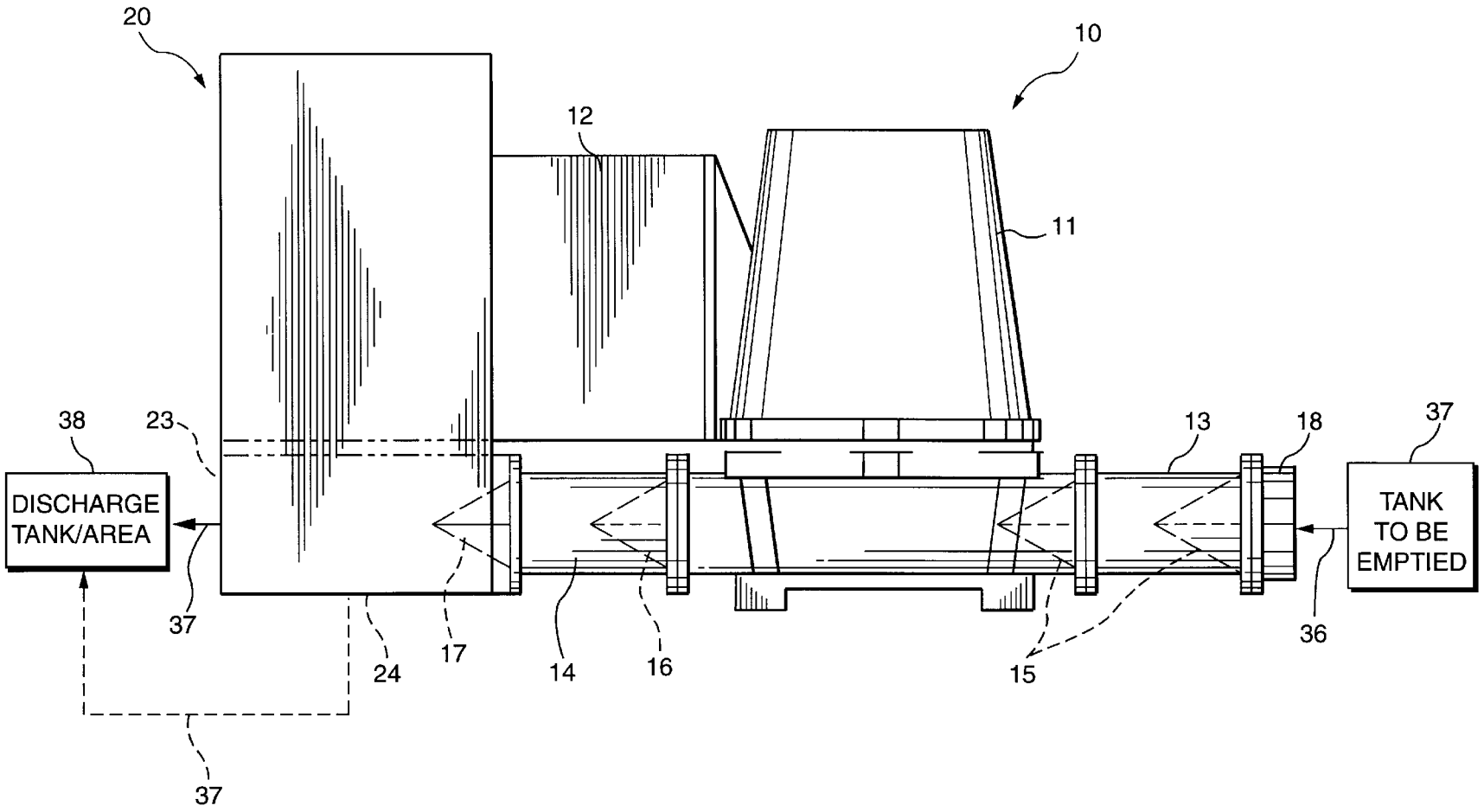
FIG. 3 is a view like that of FIG. 1 but showing the pulsation dampener of FIG. 2 mounted in place, and connected up to a tank to be emptied and a discharge tank or area.
Figure 4:
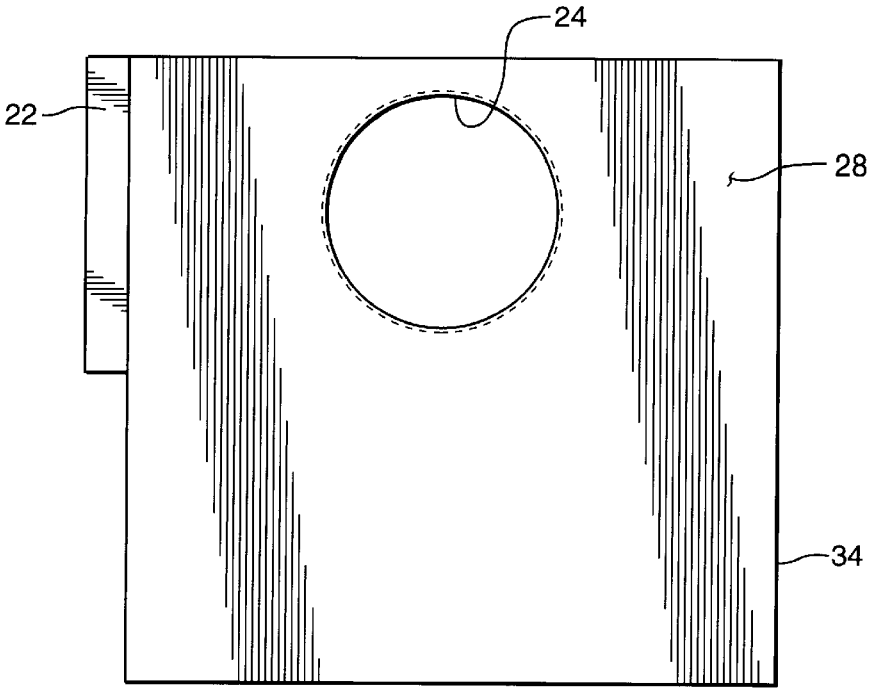
FIG. 4 is a bottom plan view of the pulsation dampener of FIG. 2.
Figure 5:
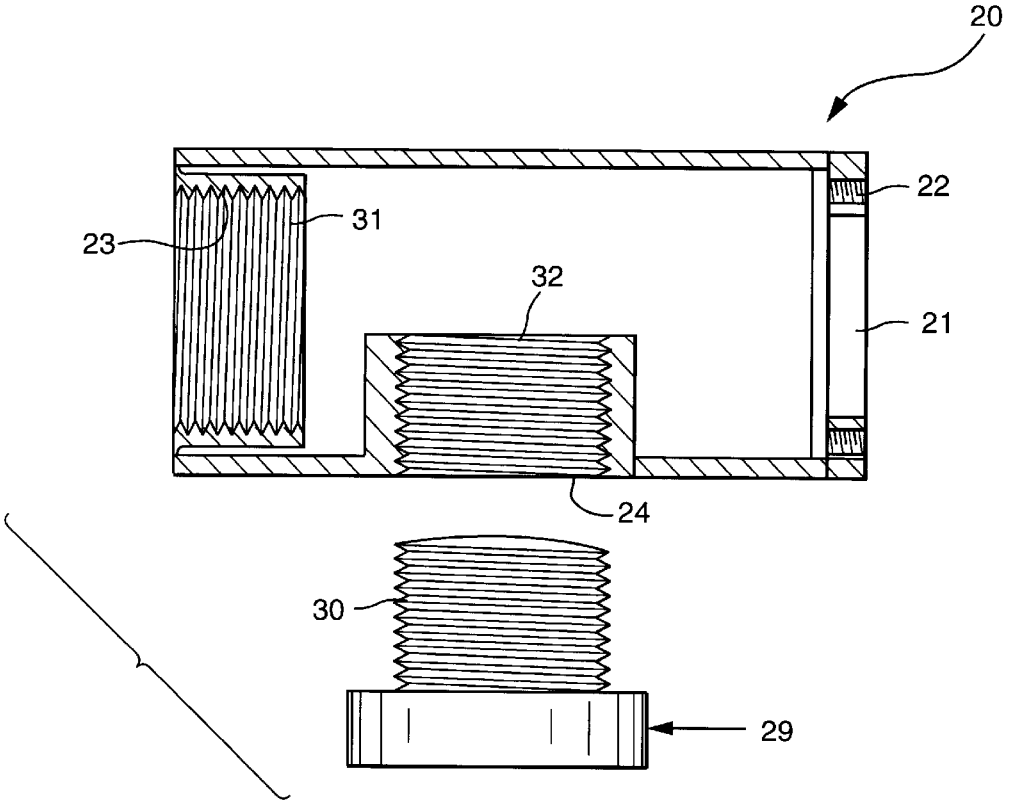
FIG. 5 is a cross-sectional view of the pulsation dampener of FIG. 2 taken at a portion thereof containing the inlets and outlets, and showing the inlets and outlets in cross-section.
Figure 6:
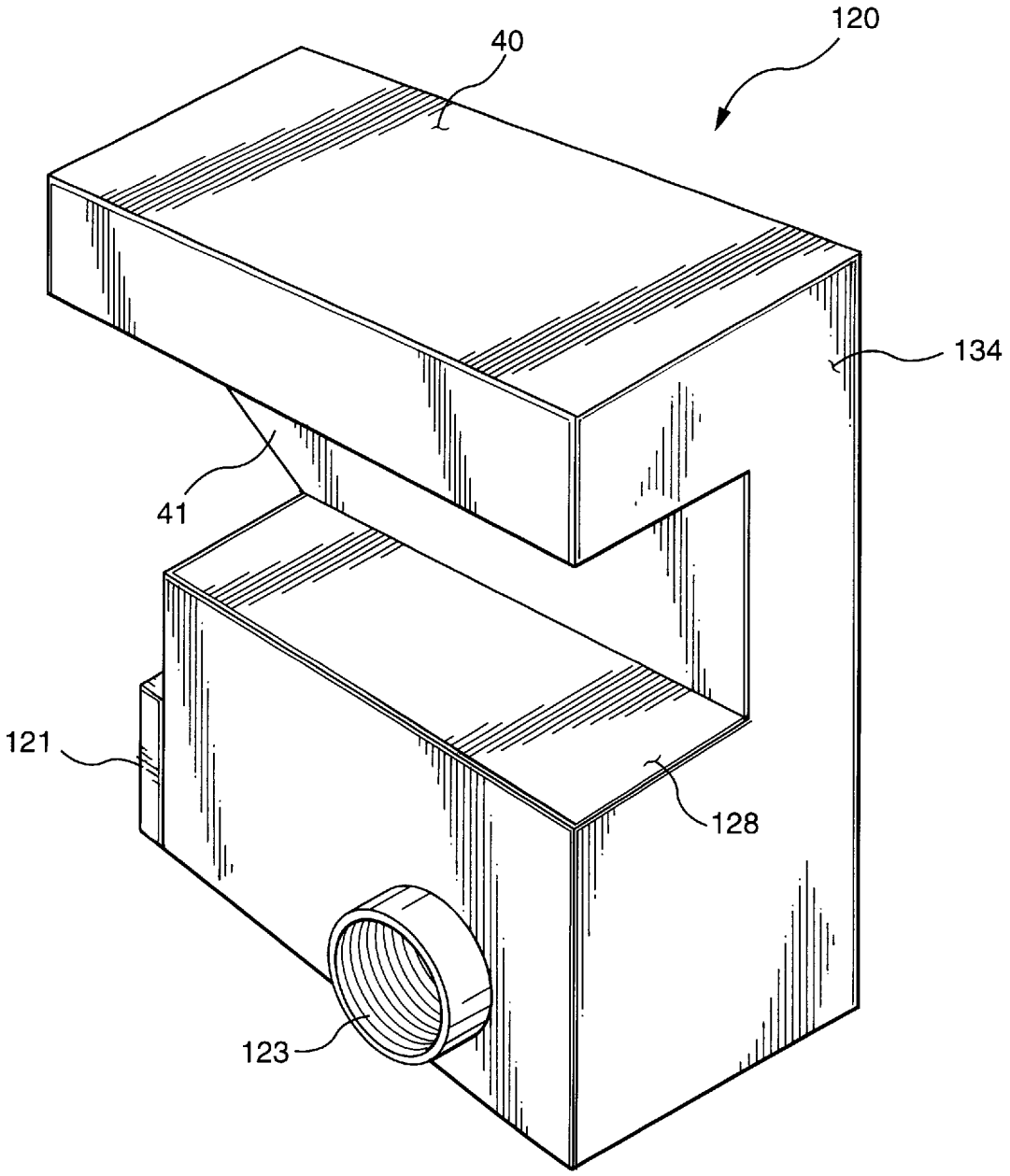
FIG. 6 is a perspective view of a second embodiment of the pulsation dampener according to the present invention.
Figure 7:
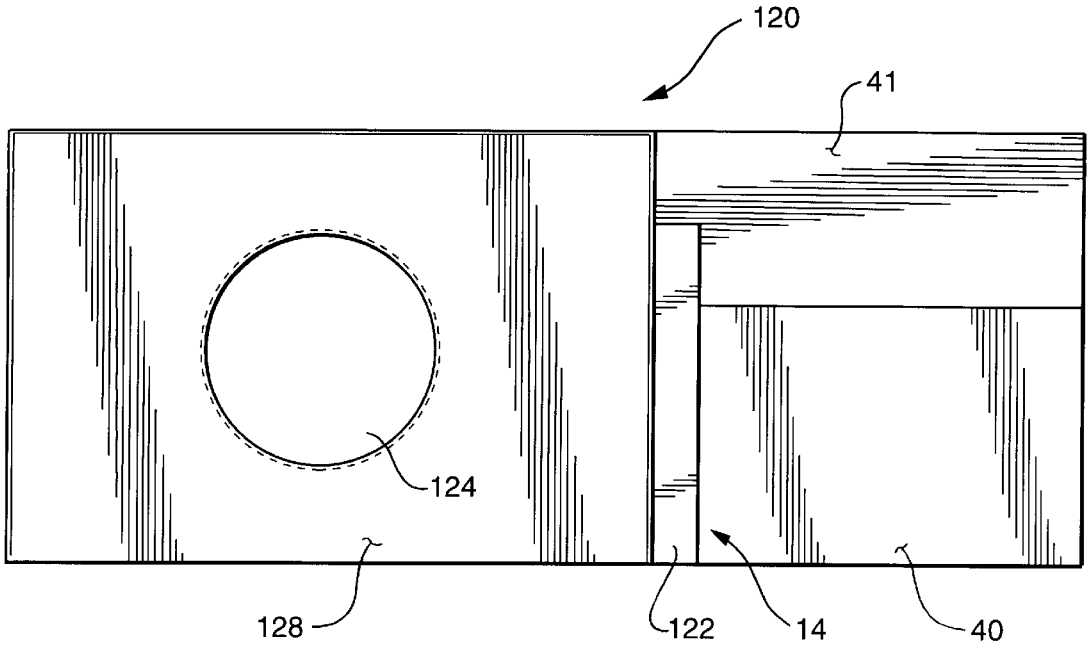
FIG. 7 is a bottom plan view of the pulsation dampener of FIG. 6.
Figure 8:
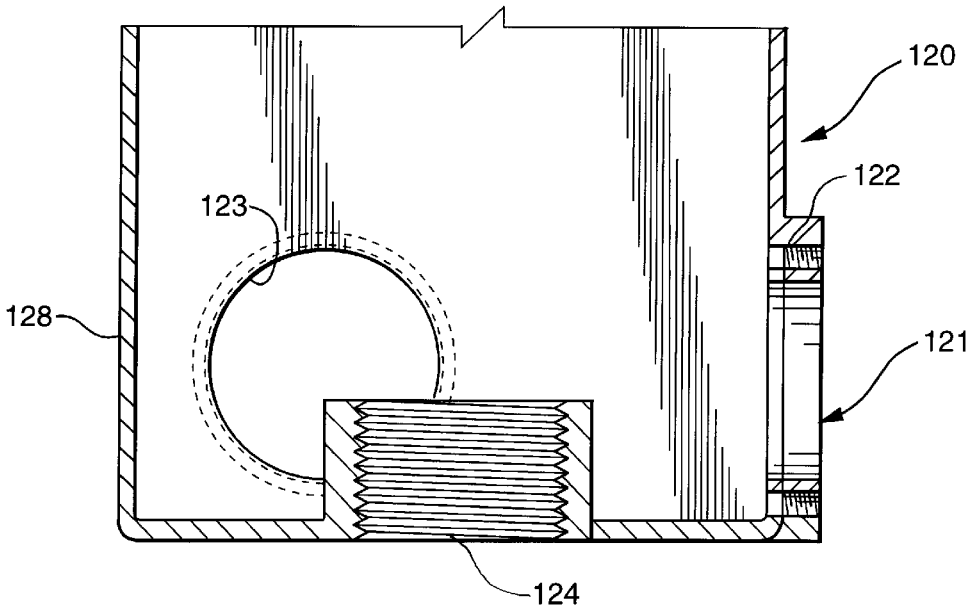
FIG. 8 is a view like that of FIG. 5 only for the pulsation dampener of FIGS. 6 and 7.
Figure 9:
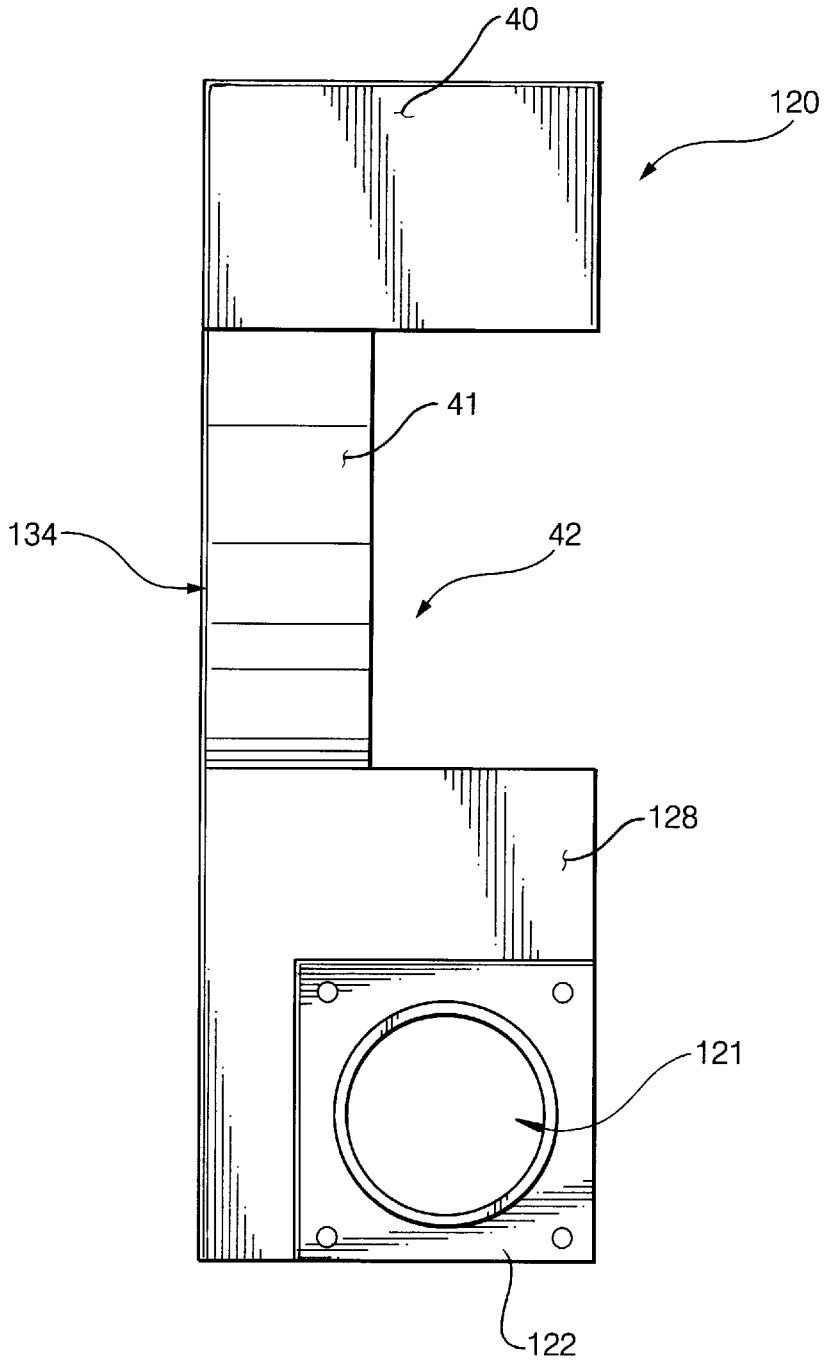
FIG. 9 is an end view, looking in on the inlet, of the pulsation dampener of FIGS. 6 through 8.

For the embodiment illustrated in FIGS. 2 through 5 the pulsation dampener 20 is substantially L-shaped viewed from the dampener inlet 21, as can be seen most clearly in FIG. 2. The dampener 20 includes a first portion 28 which has a substantially parallelepiped configuration, and contains the inlet 21 and the outlets 23, 24. In use one of the outlets 23, 24 is closed by a plug 29 (see FIG. 5), typically one which as exterior screw threads 30 which cooperate with interior screw threads 31 or 32 for the outlets 23, 24, as seen in FIG. 5.

The dampener 20, as seen most clearly in FIGS. 2 through 4, further includes a second portion 34 also having a substantially parallelepiped configuration and extending vertically upwardly from the first portion 28 (as well as being disposed next to it), and defining a majority of the chamber 26. The chamber 26, and the whole pulsation dampener 20 in general, typically will have an interior volume (which includes gas that may be compressed) of roughly between 250–400 cubic inches for most conventional marine tank pumpout systems. For example the second portion 34 of the pulsation dampener 20 may have a length of about 6.5 inches, a width of about 3.75 inches, and a height of about twelve inches, while the first portion 28 has a length substantially the same as that of the second portion 34, a width of about 2.25 inches, and a height of about three inches. The inlet 21 and outlets 23, 24 may have effective diameters of about one and one-half inches.

The pulsation dampener 20 is mounted in association with the conventional pumpout assembly 10 of FIG. 1, as illustrated in FIG. 3, merely by removing the end termination 14' of the outlet 14 (shown detached from the rest of the assembly in FIG. 1) and connecting the outlet 14 directly to the inlet 21, so that the second check valve 17 in the outlet 14 is within the first portion 28. The plate 22 may be bolted, screwed, or otherwise attached in a conventional manner to the outlet 14.

FIG. 3 shows the pumpout system according to the invention, which includes the assembly 10 and the pulsation dampener 20. It will be seen that the pulsation dampener 20 is dimensioned and configured and positioned so that it nests with the motor 12, the motor 12 being disposed just above the first portion 28 and next to and immediately adjacent the second portion 34. As seen in FIG. 3 the entire system takes up substantially no more useful space with the pulsation dampener 20 than without it (compare FIGS. 1 and 2).

FIG. 3 also shows a system according to the present invention wherein the connection 18 is connected up—as by a flexible hose or the like, shown only very schematically at 36 in FIG. 3—to a marine tank 37 to be emptied, such as a holding tank, bilge tank, or product containing tank. FIG. 3 also shows one of the outlets 23, 24—the outlet 23 being shown connected up in solid line—by a suitable conduit 37 (such as a piece of rigid PVC pipe) to a suitable discharge tank or area 38. Both of the outlets 23, 24 are provided to accommodate the most common hookup arrangements for a conventional pumpout system assembly 10, either of the outlets 23, 24 being readily attachable to a screw threaded fitting of a conduit 37 while the other is filled with the plug 29.

FIGS. 6 through 9 illustrate another embodiment of pulsation dampener according to the present invention, this embodiment having portions thereof comparable to those of the FIGS. 2 through 5 embodiment shown by the same reference numeral only preceded by a "1". In this embodiment instead of the outlet 123 being aligned with the inlet 121 (as is the case for the outlet 23 and the inlet 21 in the FIGS. 2 through 5 embodiment), the outlet 123 extends horizontally outwardly from the dampener 120 substantially transverse to the inlet 121. The outlet 124 is in the bottom. Again one of the outlets 123, 124 will have a plug (such as the plug 29 in FIG. 5) therein while the other is screw threaded or otherwise appropriately connected to the conduit 37 (see FIG. 3).

The major difference between the pulsation dampener 120 and the pulsation dampener 20 is the configuration, the pulsation dampener 120 being configured to use specifically with a different type of conventional pumpout assembly than the assembly 10 illustrated in FIGS. 1 and 3. The pulsation dampener 120 has a generally C-shape (when viewed from the inlet 21) configuration, as seen most clearly in FIG. 9. The dampener 120 includes a first portion 128 containing the inlet 121 and outlets 123, 124, and a second portion 134 extending vertically upwardly from the first portion 128 and having a bottom area (see FIGS. 6 and 9 in particular) significantly less than (e.g. less than half of) a top area of the first portion 128. The dampener 120 also includes a third portion 40 extending horizontally outwardly from the second portion 134 at a top of the second portion 134, and overhanging the first portion 128, as seen most clearly in FIGS. 6 and 9. The dampener 120 also includes a side wall 41 overlying the dampener inlet 121 and extending at an angle of between about 30°–60° (e.g. about 45°) to the horizontal away from the inlet 121 (back toward the pump 11 when connected thereto).

When the pulsation dampener 120 of FIGS. 6 through 9 is used with a pumpout assembly generally similar to, but having a different configuration from, the assembly 10 the motor (11) and the pulsation dampener 120 are positioned with respect to each other so that the motor nests with the pulsation dampener 120, with the motor between the first and third portion 128, 40, and adjacent the second portion 134. That is the motor is disposed in the open area—shown generally by reference numeral 42 in FIG. 9—of the C-shape of the dampener 120.

The dimensions of the dampener 120 may vary widely. One exemplary size is for the maximum length of third portion 40 to be about twelve inches and its width four inches, for the first position 128 to have a length of about seven inches, and a width of about four inches, the entire unit 120 to have a height of about twelve inches, and all other dimensions to the scale indicated in the drawings. The total volume is about 200–400 cubic inches.

It will thus be seen that according to the present invention a marine tank pumpout system utilizing a pulsation dampener, and various embodiments of pulsation dampeners per se, have been provided which are particularly advantageous. They include no moving parts, may readily be retrofit to existing installations, are inexpensive and simple to construct utilize, have long life, and when incorporated into a marine tank pumpout system the system takes up substantially no more useful space than without the pulsation dampener. While the invention has been shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A marine tank pumpout system, comprising:

a positive displacement pump having an inlet and an outlet;

said inlet and outlet each including at least one check valve;

a first connection to said inlet to connect said inlet to a marine tank to be emptied;

a pulsation dampener having an inlet connected to said pump outlet and including an open chamber extending upwardly from said pump outlet into which pumped fluent material may flow; said inlet connected to said open chamber;

said pulsation dampener also including at least one outlet from said open chamber; distinct and spaced from said inlet to said open chamber, said open chamber including no moving parts; and a second connection from said pulsation dampener to connect said pulsation dampener to a discharge tank or area.

2. A system as recited in claim 1 wherein said pulsation dampener has first and second differently directed outlets; and wherein one of said pulsation dampener outlets is connected to said connection to a discharge area or tank, and the other includes a plug disposed therein.

3. A system as recited in claim 2 wherein a check valve from said pump outlet extends into said pulsation dampener inlet.

4. A system as recited in claim 1 wherein said pump comprises a reciprocating diaphragm pump, and wherein said pulsation dampener inlet is directly connected to said pump outlet, and said pulsation dampener has an interior volume of about 250–400 cubic inches.

5. A system as recited in claim 1 wherein said pulsation dampener is substantially L-shaped when viewed from said dampener inlet and includes a first portion generally having a substantially parallelepiped configuration and containing said inlet and said outlets, and a second portion generally having a substantially parallelepiped configuration and extending vertically upwardly from said first portion and defining the majority of said chamber.

6. A system as recited in claim 1 wherein said pulsation dampener is generally C-shaped when viewed from said dampener inlet and includes a first portion having a substantially parallelepiped configuration and containing said inlet and said outlets; a second portion extending vertically upwardly from said first portion and having a bottom area significantly less than a top area of said first portion; and a third portion extending horizontally outwardly from said second portion at a top of said second portion and overhanging said first portion.

7. A system as recited in claim 1 further comprising a flexible hose with a releasable connection for connection to a marine tank; and in combination with a marine tank so that said pump withdraws fluent material from said marine tank and pumps it to a discharge tank or area.

8. A system in combination with a marine tank as recited in claim 7, wherein said marine tank comprises a holding tank for a marine toilet system.

9. A system in combination with a marine tank as recited in claim 7, wherein said marine tank comprises a bilge tank, or a liquid product tank.

10. A pulsation dampener comprising:

a pulsation dampener casing comprising: an inlet connectable to a pump outlet; an open chamber extending upwardly from said inlet into which pumped fluent material may flow; at least one outlet from said chamber; and said chamber including no moving parts; and wherein said pulsation dampener casing is substantially L-shaped when viewed from said dampener inlet and includes a first portion generally having a substantially parallelepiped configuration and containing said inlet and said outlets, and a second portion generally having a substantially parallelepiped configuration and extending vertically upwardly from said first portion and defining the majority of said chamber.

11. A pulsation dampener as recited in claim 10 wherein said at least one outlet in said first portion comprise a first outlet horizontally in line with said inlet, and a second outlet opening downwardly, a plug disposed in one of said outlets.

12. A pulsation dampener as recited in claim 10 wherein said casing comprises eleven gauge stainless steel, and has an interior volume of between 250–400 cubic inches.

13. A pulsation dampener comprising:

a pulsation dampener casing comprising: an inlet connectable to a pump outlet; an open chamber extending upwardly from said inlet into which pumped fluent material may flow; at least one outlet from said chamber; and said chamber including no moving parts; and wherein said pulsation dampener casing is generally C-shaped when viewed from said dampener inlet and includes a first portion having a substantially parallelepiped configuration and containing said inlet and said outlets; a second portion extending vertically upwardly from said first portion and having a bottom area significantly less than a top area of said first portion; and a third portion extending horizontally outwardly from said second portion at a top of said second portion and overhanging said first portion.

14. A pulsation dampener as recited in claim 13 wherein said second portion includes a side wall overlying said dampener inlet, and extending at an angle of between about 30°–60° to the horizontal back over and horizontally past said inlet.

15. A pulsation dampener as recited in claim 13 wherein said first portion at least one outlet comprises a first outlet facing downwardly from said first portion, and a second outlet disposed substantially perpendicularly to said inlet, and horizontally directed, a plug disposed in one of said outlets.

16. A marine tank pumpout system, comprising:

a positive displacement pump having an inlet and an outlet;

said inlet and outlet each including at least one check valve;

a first connection to said inlet to connect said inlet to a marine tank to be emptied;

a pulsation dampener having an inlet connected to said pump outlet and including an open chamber extending upwardly from said pump outlet into which pumped fluent material may flow; said pulsation dampener also including at least one outlet from said chamber; said chamber including no moving parts;

a second connection from said pulsation dampener to connect said pulsation dampener to a discharge tank or area; and wherein said pulsation dampener is substantially L-shaped when viewed from said dampener inlet and includes a first portion generally having a substantially parallelepiped configuration and containing said inlet and said outlets, and a second portion generally having a substantially parallelepiped configuration and extending vertically upwardly from said first portion and defining the majority of said chamber.

17. A system as recited in claim 5 wherein said pump includes a motor, and wherein said motor and said pulsation dampener are positioned with respect to each other so that said motor nests with said pulsation dampener with said motor above said first portion and next to said second portion, so that the system takes up substantially no more useful space with said pulsation dampener than without it.

18. A system as recited in claim 17 wherein said at least one outlet in said first portion comprises a first outlet horizontally in line with said inlet, and a second outlet opening downwardly.

19. A marine tank pumpout system, comprising:

a positive displacement pump having an inlet and an outlet;

said inlet and outlet each including at least one check valve;

a first connection to said inlet to connect said inlet to a marine tank to be emptied;

a pulsation dampener having an inlet connected to said pump outlet and including an open chamber extending upwardly from said pump outlet into which pumped fluent material may flow; said pulsation dampener also including at least one outlet from said chamber; said chamber including no moving parts;

a second connection from said pulsation dampener to connect said pulsation dampener to a discharge tank or area; and wherein said pulsation dampener is generally C-shaped when viewed from said dampener inlet and includes a first portion having a substantially parallelepiped configuration and containing said inlet and said outlets; a second portion extending vertically from said first portion and having a bottom area significantly less than a top area of said first portion; and a third portion extending horizontally outwardly from said second portion at a top of said second portion and overhanging said first portion.

20. A system as recited in claim 19 wherein said second portion includes a side wall overlying said dampener inlet, and extending at an angle of between about 30°–60° to the horizontal back toward said pump.

21. A system as recited in claim 19 wherein said pump includes a motor, and wherein said motor and said pulsation dampener are positioned with respect to each other so that said motor nests with said pulsation dampener with said motor between said first and third portions, and adjacent said second portion, so that the system takes up substantially no more useful space with said pulsation dampener than without it.

22. A system as recited in claim 19 wherein said first portion at least one outlet comprises a first outlet facing downwardly from said first portion, and a second outlet disposed substantially perpendicularly to said inlet, and horizontally directed.

* * * * *